US006662503B2

(12) United States Patent
Cowell et al.

(10) Patent No.: US 6,662,503 B2
(45) Date of Patent: Dec. 16, 2003

(54) BATHING ENCLOSURE WALL PANEL

(75) Inventors: Brian D. Cowell, Fond du Lac, WI (US); Richard A. Olson, Sheboygan, WI (US); Mark A. Rothwell, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/116,161

(22) Filed: Apr. 4, 2002

(65) Prior Publication Data

US 2003/0188379 A1 Oct. 9, 2003

(51) Int. Cl.[7] ..... A47K 3/16; E06B 3/00; E06B 7/00

(52) U.S. Cl. ..... 52/35; 52/762; 52/764; 52/204.55; 52/204.597; 52/204.6; 52/204.71

(58) Field of Search ..... 52/35, 762, 764, 52/204.55, 204.597, 204.6, 204.71, 282.2, 309.1, 309.5, 783.1, 788.1, 796.1; 56/244.11–244.27; 427/209; 428/432, 461, 462

(56) References Cited

U.S. PATENT DOCUMENTS

| | | | | |
|---|---|---|---|---|
| 1,035,924 | A | | 8/1912 | Tyden |
| 2,282,362 | A | * | 5/1942 | Johnson ..... 52/35 |
| 2,343,201 | A | * | 2/1944 | Nilson ..... 52/264 |
| 3,276,177 | A | | 10/1966 | Keller |
| 3,939,620 | A | | 2/1976 | Bero |
| 3,958,388 | A | | 5/1976 | Hawes |
| 4,152,790 | A | | 5/1979 | Obradovits |
| 4,184,297 | A | | 1/1980 | Casamayor |
| 4,248,018 | A | | 2/1981 | Casamayor |
| 4,289,818 | A | | 9/1981 | Casamayor |
| 4,341,883 | A | | 7/1982 | Gift |
| 4,384,077 | A | | 5/1983 | Gift |
| 4,387,138 | A | | 6/1983 | Gift |
| 4,409,758 | A | | 10/1983 | Dickerson et al. |
| 4,488,919 | A | | 12/1984 | Butler |
| 4,594,828 | A | | 6/1986 | Taylor |
| 4,622,797 | A | | 11/1986 | Wuster |
| D297,264 | S | | 8/1988 | Dickerson |
| 4,875,958 | A | | 10/1989 | Kurokawa |
| 5,094,057 | A | | 3/1992 | Morris |
| 5,262,894 | A | | 11/1993 | Wheatley et al. |
| 5,409,777 | A | | 4/1995 | Kennedy et al. |
| 5,419,093 | A | | 5/1995 | Wei |
| 5,444,115 | A | | 8/1995 | Hu et al. |
| 5,598,674 | A | * | 2/1997 | Lay et al. ..... 52/309.1 |
| 5,623,802 | A | | 4/1997 | Boushek et al. |
| 5,759,658 | A | | 6/1998 | Piekos |
| 5,787,665 | A | | 8/1998 | Carlin et al. |
| 5,822,940 | A | | 10/1998 | Carlin et al. |
| 5,856,389 | A | | 1/1999 | Kostrzewski et al. |
| 5,901,528 | A | | 5/1999 | Richardson |
| 6,004,484 | A | | 12/1999 | Faris et al. |
| 6,030,483 | A | | 2/2000 | Wilson |
| 6,076,204 | A | | 6/2000 | Mullick |
| 6,099,971 | A | | 8/2000 | Faris et al. |
| 6,131,340 | A | | 10/2000 | Clark et al. |
| 6,207,236 | B1 | | 3/2001 | Araki et al. |
| 6,254,712 | B1 | * | 7/2001 | Enlow et al. ..... 156/244.11 |
| 6,337,129 | B1 | | 1/2002 | Watanabe et al. |
| 6,339,907 | B1 | | 1/2002 | Dame et al. |

OTHER PUBLICATIONS

Documentation obtained off of internet concerning Acrylic Mirror products available from Plaskolite, Inc., obtained at http://www.plasticsmag.com, http://216.239.39.100.

* cited by examiner

*Primary Examiner*—Jeanette Chapman
(74) *Attorney, Agent, or Firm*—Quarles & Brady LLP

(57) ABSTRACT

A bathing enclosure wall panel and framing therefor are disclosed. In one embodiment there is a frosted, translucent, colored acrylic that is backed by a mirroring metal such as aluminum. There can also be a waterproofing paint layer behind the reflective material, as well as a cellulosic backing layer to reduce flexing. The material reflects light but does not present a risque appearance.

14 Claims, 3 Drawing Sheets

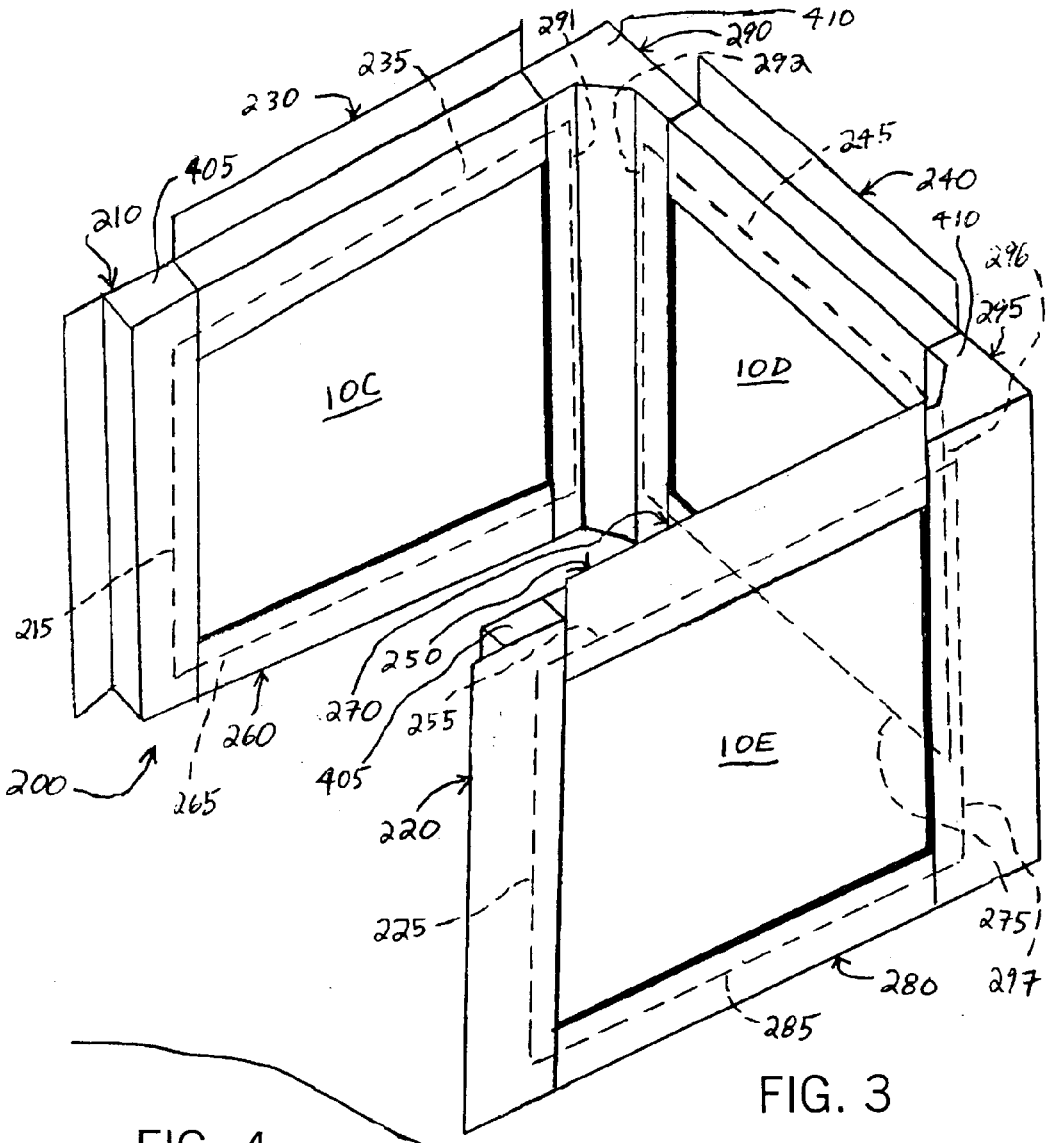
FIG. 3
FIG. 4
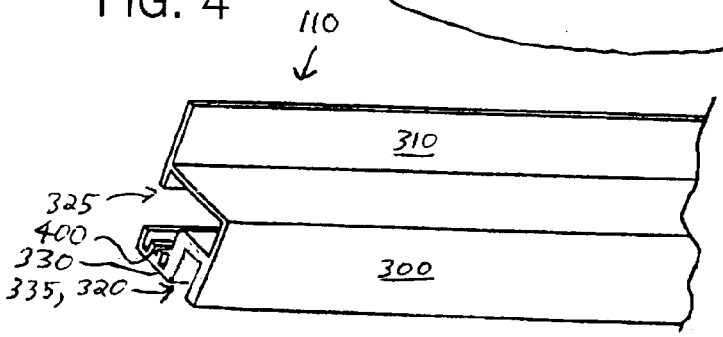

BATHING ENCLOSURE WALL PANEL

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to wall paneling for use in bathing enclosures such as showers and shower baths, and more particularly to such paneling that presents interesting and unique aesthetic effects.

Contemporary showers commonly have wall panels that are made from plastic materials. Such materials are lightweight, easy to install, and to some extent heat insulating. However, when they are transparent or translucent they can present privacy problems. When they are opaque they reduce the privacy concern but may create a bland and dark appearance unless strong lighting is provided (because they block light and do not reflect it very well).

Some double-layer laminates have been developed for various construction applications. Some of these provide frosting in clear acrylic. This gives the acrylic material a frosted appearance (e.g., semi-translucent and cloudy with or without identifiable speckled particles), which makes the surface of the acrylic appear more interesting. However, it does not address the lighting issue.

Other double-layer laminates have been designed to have a clear, colored acrylic layer coated with a rear mirroring material (such as a reflective metal). However, if this laminate were to be used as a bathing enclosure wall, it would present an appearance considered overly flashy or risque by many consumers. Exemplary dual-layer laminates that employ colored acrylic material backed by reflective material include the "Acrylic Mirror" products manufactured by Plaskolite, Inc. of Columbus, Ohio.

Another problem with adapting such laminates for application in a showering environment is that acrylic materials (while somewhat resistant to disfigurements) could be exposed to a variety of abrasive and scratching forces and harsh chemicals in a shower environment. Over time, this could harm the overall appearance of exposed acrylics.

Further, standard acrylics, even if backed by a reflective metal, are flexible. ANSI building codes require that the flexibility of shower units be restricted (e.g., to less than a ¼" deformation of a panel upon application of a 25 lb force to that panel). Application of conventional backing materials, such as a fiberglass resin, to the back of the double-layer laminate (along the reflective material layer), has a tendency to damage thin reflective metal layers.

Further, there are problems involved in how to hold the various wall panels together, without leaving unsightly connectors or leakage pathways.

Thus, it can be seen that a need exists for an improved type of bathing enclosure wall panel.

SUMMARY OF THE INVENTION

In one aspect the present invention provides a bathing enclosure wall panel. It has a first layer of acrylic material with a translucent and frosted appearance, a second layer of reflective material that is coupled to the first layer, and at least a third layer of an additional material that is coupled to one of the first layer and the second layer.

In preferred forms the first layer is extruded acrylic material and includes a frosting additive and colorant. The second layer can be a suitable mirroring metal such as aluminum. The third layer can be a backing layer connected to the second layer and be made of a spacer material. The spacer material can be a cellulosic material such as a double-faced hexacomb cardboard material, or any of a variety of other materials, particularly non-absorbent materials such as polymeric foam materials.

In other forms there can be a protective paint coating sandwiched between the third layer and the second layer, wherein the protective paint coating is urethane paint.

In especially preferred forms, two or three of the panels can be mounted in frame supports that surround the four edges of each panel. The frame supports include internal, inwardly facing grooves for receiving the edges of the panels. The legs of the frame support can be screwed to each other.

The paneling has a bright, visually stimulating and aesthetically pleasing, unique appearance that provides enhanced lighting within a shower without having to increase electrical usage or bulb wattage, and without resorting to designs that are overly flamboyant.

An anti-scratch coating is preferably applied to the front surface of the panel on top of the frosted acrylic material. This provides a longer useful life.

The legs of the frame support are preferably seven or ten (depending upon whether two or three panels are being supported) extruded bars with receiving grooves to receive the panels. The legs can be screwed together, or potentially several (e.g., three) of them can be formed together. For example, in a two-panel assembly, potentially three of the legs surrounding each of the panels can be formed together, positioned onto their respective panels, and then an intermediate leg can be positioned between the two panels to complete the assembly.

It will be appreciated that the panel is relatively lightweight, can be preassembled/constructed in an automated factory, and is particularly well designed for use in a showering environment. These and other advantages of the invention will be apparent from the detailed description and drawings which follow.

BRIEF DESCRIPTION OF THE DRAWINGS

FIG. 3 is a perspective view of a three-paneled bathing enclosure incorporating three of the wall panels of FIG. 1, in which the panels are shown to be supported in a frame including end legs, top legs, bottom legs, and corner legs;

FIG. 4 is a perspective view of one of the end/top legs employed in the frames of FIGS. 2 and 3;

DETAILED DESCRIPTION OF THE PREFERRED EMBODIMENT

Figure 1:
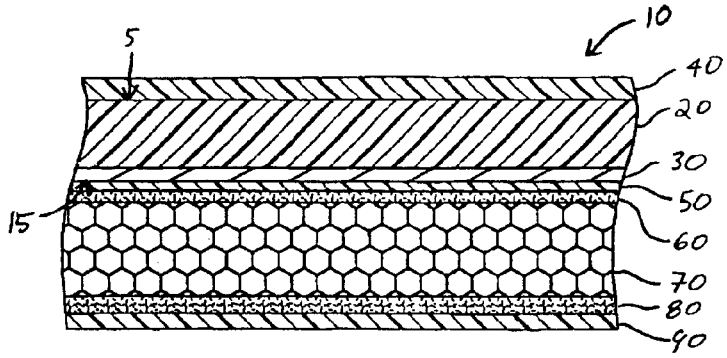
FIG. 1 is a cross-sectional view of a preferred bathing enclosure wall panel of the present invention.

Referring first to FIG. 1, a panel 10 includes eight different layers. The first layer of the laminate is a frosted acrylic material layer-20 made from any of a variety of different types of acrylic materials such as, for example, the PL25 extruded acrylic available from Plaskolite, Inc. of Columbus, Ohio. Although somewhat translucent, the layer 20 includes an organic or inorganic frost additive that causes the frosted acrylic material layer to have a frosted appearance (e.g., somewhat cloudy with or without identifiable speckled particles), such that only a portion of the light incident on the layer is transmitted through the layer. One example of a frosted acrylic material layer including such a frost additive and having such a translucent, frosted appearance is the Optix Frost acrylic sheet available from Plaskolite, Inc.

Other sources of frosted acrylic material layer are Plexiglas® frosted acrylic available from Elf Atochem North America Inc. of Philadelphia, PA, and Acriglas® custom acrylic material available from Acrilex Inc. of Jersey City, NJ. The layer 20 can also include a color additive to tint the layer a particular color. For example, in one embodiment, the frosted acrylic material layer 20 includes a 3030 green color concentrate additive (available from a variety of acrylic manufacturers), such that the layer has a light green appearance.

Behind the frosted acrylic material layer 20 is a reflective layer 30, which has a shiny, metallic, reflective appearance (and acts as a mirror). The layer 30 is very thin, and can be applied in vaporous form (e.g., vacuum-deposited) onto the frosted acrylic material layer 20. In one embodiment, the reflective material layer 30 is a layer of aluminum that is 900–1100 angstroms thick, although in alternate embodiments the layer can be formed from other materials (e.g., silver) and can have any of a variety of different thicknesses based upon the type and amount of reflective material that is employed.

The combination of the frosted acrylic material layer 20 and the reflective material layer 30 primarily provides the panel 10 with its distinctive appearance. Some of the light that is incident upon a front surface 5 of the frosted acrylic material layer 20 (e.g., the surface of that layer that is not in contact with the reflective material layer 30) is transmitted through that layer to the reflective material layer, reflected by the reflective material layer, and transmitted back through and out of the frosted acrylic material layer. However, other of the incident light instead is reflected by the frosted acrylic material layer.

The combination of the frosted acrylic material layer 20 (whether colored or not) and the reflective material layer 30 provides the shower wall panel 10 a bright, visually stimulating appearance that, at the same time, is not as flashy or flamboyant as in the case of a conventional double-layer laminate having a clear acrylic material layer backed by a reflective material layer. Due to the combination of the frosted acrylic material layer 20 and the reflective material layer 30, the lighting conditions in a shower in which the shower wall panel 10 is installed are relatively consistent and not overly bright or dark.

A preferred additional layer is a protective coating layer 40 affixed to the front surface 5 of the frosted acrylic material layer 20. This protective coating layer 40, which is preferably completely transparent and can be colored or colorless, provides the shower wall panel 10 with abrasion and stain resistance as well as resistance to exposure to chemicals such as soaps, shampoos, and cleansers. Although a variety of different materials could be used, in one embodiment the layer is ARmadillo scratch-resistant coating available from Plaskolite, Inc.

There may also be a protective paint layer 50, which is painted directly upon the surface 15 of the layer 30. In one embodiment, the protective paint layer can be a urethane-based paint. The paint layer is added to prevent scratching or other damage to the reflective material layer 30, as well as to waterproof the panel 10.

Affixed successively behind the protective paint layer 50 are a first adhesive layer 60, a spacing layer 70, a second adhesive layer 80, and a support layer 90. In the embodiment shown, the first and second adhesive layers 60 and 80 are employed to attach the spacing layer 70 to the protective paint layer 50 and the support layer 90, respectively. However, in alternate embodiments some or all of these three layers 50,70 and 90 can be attached to one another without discrete layers of adhesives. The adhesive layers 60 and 80, when employed, can be any of a variety of adhesives such as, for example, the NF-FB30 adhesive available from the 3M Company of St. Paul, Minn.

The support layer 90 can be any stiff (e.g., relatively unbendable) material that is relatively lightweight such as, for example, the Formica® laminate manufactured by the Formica Corporation of Cincinnati, Ohio. The spacing layer 70 can be any of a variety of different types of spacing materials such as cellulosic spacing materials (e.g., cardboard or paper), plastics, polymeric foam (or other types of foam), or other materials, particularly non-absorbent materials.

In a preferred embodiment, the spacing layer 70 is a layer of double-faced hexacomb cardboard available from Pactiv Corp., of Lake Forest, Ill. Hexacomb cardboard is preferred because it allows the support layer 90 to provide desired support to the frosted acrylic material layer 20 and the reflective material layer 30 without directly contacting those materials (or contacting the protective paint layer 50), and at the same time is lightweight and resistant to compression and expansion. The support layer 90 in particular provides desired support against bending of the layers 20,30 (as well as layers 40,50) both because the support layer resists bending of itself and also because the support layer counteracts tensile forces that occur along the length of the support layer when the layers 20,30 are being bent.

Figure 2:
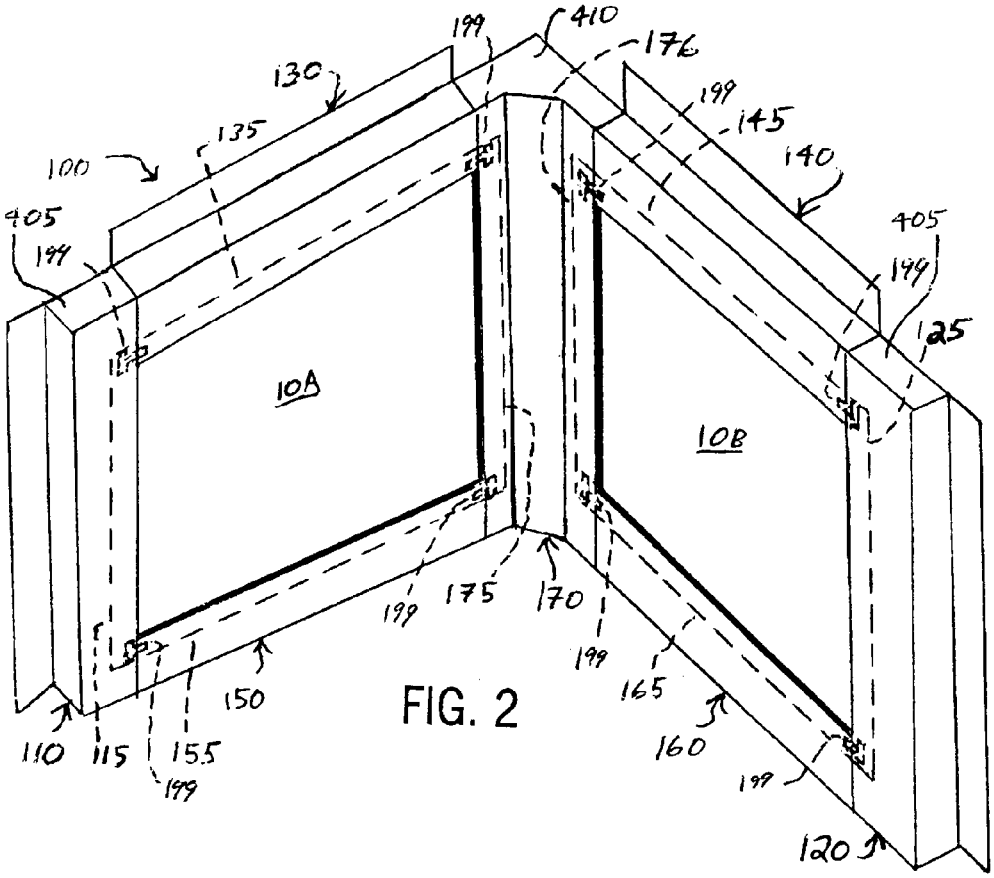
FIG. 2 is a perspective view of a two-paneled bathing enclosure incorporating two of the wall panels of FIG. 1, in which the panels are shown to be supported in a frame including end legs, top legs, bottom legs, and a corner leg.

Referring to FIGS. 2 and 3, two of the panels 10 (specifically, panels 10A and 10B) and three of the panels (specifically, panels 10C,10D and 10E) are shown to be supported, respectively, by a two-panel frame support 100 and a three-panel frame support 200. Specifically with respect to FIG. 2, the two-panel frame support 100 includes two end legs 110 and 120, two top legs 130 and 140, and two bottom legs 150 and 160, and a single corner leg 170 The end legs 110 and 120 are positioned respectively along end edges 115 and 125 of the panels 10A and 10B, respectively, the end top legs 130 and 140 are positioned respectively along top edges 135 and 145 of the panels 10A and 10B, respectively, the bottom legs 150 and 160 are positioned along bottom edges 155 and 165 of the panels 10A and 10B, respectively, and the corner leg 170 is positioned along each of inner edges 175 and 176 of the panels 10A and 10B, respectively. The edges of the panels 10A and 10B are shown in phantom.

As for the frame support 200, that frame support includes two end legs 210 and 220, three top legs 230, 240 and 250, three bottom legs 260, 270 and 280, and two corner legs 290 and 295. The end legs 210 and 220 are positioned respectively along end edges 215 and 225 of the outer panels 10C and 10E, respectively, the top legs 230,240 and 250 are positioned respectively along top edges 235,245 and 255 of the panels 10C,10D and 10E, respectively, the bottom legs 260,270 and 280 are positioned along bottom edges 265, 275 and 285 of the panels 10C,10D and 10E, respectively, the first corner leg 290 is positioned along inner edges 291 and 292 of the panels 10C and 10D, respectively, and the second corner leg 295 is positioned along inner edges 296 and 297 of the panels 10D AND 10E, respectively. The edges of the panels 10C,10D and 10E are shown in phantom.

The frame supports 100 and 200 provide both additional support to prevent bending of the shower wall panels 10A–10E, and also support to hold the panels in position with respect to other structures. The legs 110–170, 210–290 and 295 preferably are made from lightweight, inexpensive and water resistant materials such as extruded aluminum or fiberglass. In alternate embodiments, different configurations of legs forming different frame supports are possible, including frame supports holding different numbers of panels 10. For example, it would be possible to form a frame support for a single wall panel 10 using the bottom leg 150, the top leg 130, and the end legs 110 and 120. Also, it would be possible to mount two panels back-to-back to provide a double-sided panel assembly. Such a back-to-back panel assembly could employ the various legs discussed above in a frame support, or employ a frame support of a different design.

Turning to FIG. 4, a perspective view is provided of one of the end or top legs 110,120,130,140, 210,220,230,240 and 250 (e.g., the end leg 110), each of which has an identical cross section (and, in some embodiments, an identical length). As shown, the end leg 110 (and each of the other end or top legs) has a base portion 300 and a flange portion 310. The base portion 300 has a generally rectangular cross-section with first and second openings 320,325. The first opening 320 is along an interior side 330 of the base portion 300 and forms a C-bracket (or C-clamp) 335, which extends the entire length of the leg 110. The second opening 325 opens up to the remainder of the base portion exclusive of the C-bracket 335. When the end leg 110 is assembled onto its corresponding edge 115 of the shower wall panel 10A, the edge of the panel extends into the C-bracket 335, abuts the C-bracket, and is supported therein.

Figure 5:
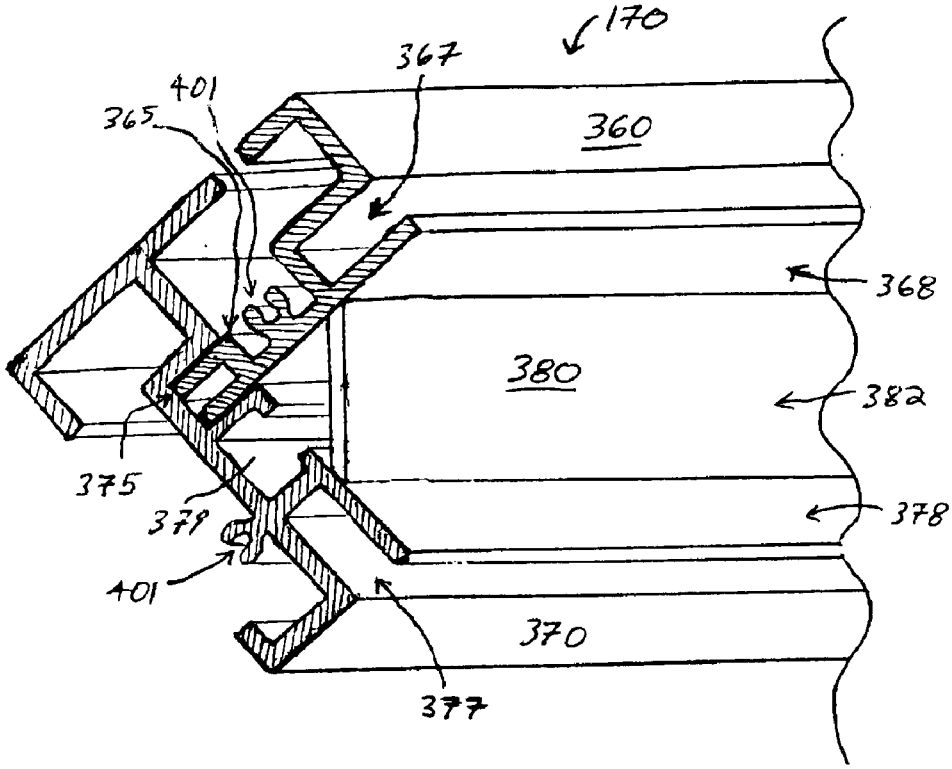
FIG. 5 is a perspective view of one of the corner legs employed in the frames of FIGS. 2 and 3.

Referring further to FIG. 5, a perspective view is provided of one of the corner legs 170, 290 and 295 (e.g., the corner leg 170), each of which has an identical cross section (and, in some embodiments, an identical length). As shown, the corner leg 170 (and each of the other corner legs) has first and second main components 360,370 and additionally a diagonal interface component 380 (for clarity, the respective ends of the first and second main components are shown to be differently cross-hatched, and the end of the diagonal interface component 380 is not cross-hatched). Further as shown, the first main component 360 is secured with respect to the second main component by way of a first end 365, which fits within a channel 375 and is fastened therein (by way of screws, bolts, snap fittings, or any of a variety of other fastening techniques). Each of the first and second main components 360,370 also has a respective C-bracket 367,377 that are oriented perpendicularly to one another when the first and second main components are coupled together. When installed as part of the frame support 100, the corner leg 170 receives and supports the edges 175 and 176 within the C-brackets 367,377, respectively.

The diagonal interface component 380 covers over the junction between the first and second main components 360,370 and provides a relatively smooth transitioning between respective interior surfaces 368,378 of those components. In the embodiment shown, the first and second main components 360,370, their interior surfaces 368,378 and their C-brackets 367,377 are respectively perpendicular such that the panels 10A and 10B supported by the corner leg 170 are respectively perpendicular. However, in alternate embodiments, different orientations of these components is possible (e.g., such that the panels 10A and 10B would be 120 degrees apart). In the embodiment shown, in which the interior surfaces 368,378 are respectively perpendicular, an outer face 382 of the diagonal interface component 380 forms an approximately 135 degree angle with each of the interior surfaces 368,378.

The diagonal interface component 380 can be fastened to the first and/or second main components 360,370 by way of a number of fastening devices. As shown, in this embodiment, the second main component 370 includes a second channel 379, which is capable of receiving a screw, bolt, clip, magnet, or other fastening component. In one embodiment, screws, magnets or bolts are used to fasten the diagonal interface component 380 (or an extension thereof extending toward the second channel 379, which is not shown) to the second main component 370 or another component that itself is fastened to the second channel 379 of the second main component (not shown).

Figure 6:
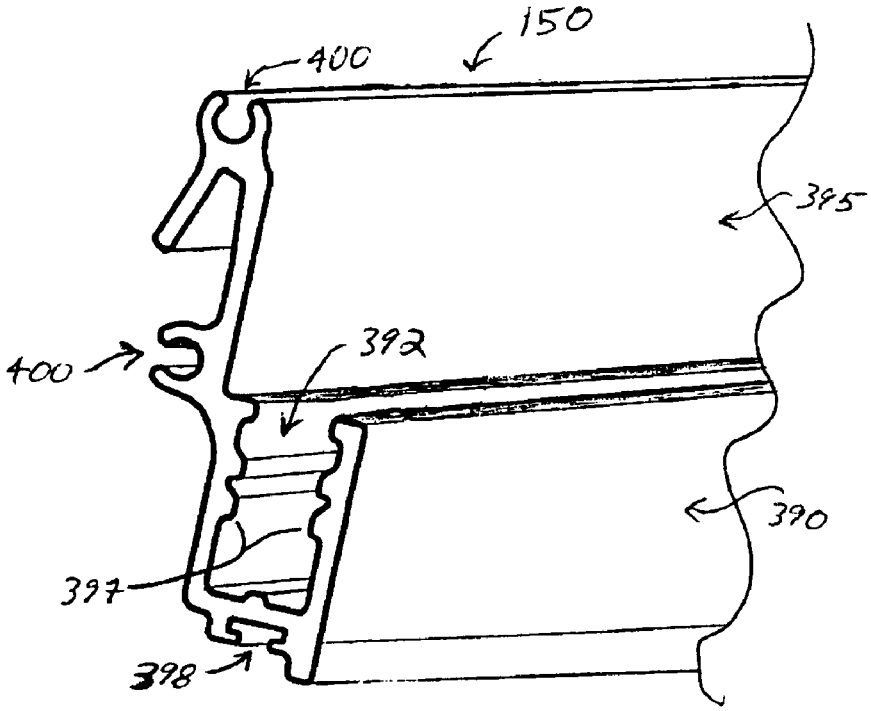
FIG. 6 is a perspective view of one of the bottom legs employed in the frames of FIGS. 2 and 3.

Referring to FIG. 6, a perspective view is provided of one of the bottom legs 150,160,260,270 and 280 (e.g., the bottom leg 150), each of which has an identical cross section (and, in some embodiments, an identical length). As shown, the bottom leg 150 (and each of the other bottom legs) has a base portion 390 and a flange portion 395. The base portion 390 has a generally rectangular cross-section with a C-bracket 392, which extends the entire length of the leg 150. When the bottom leg 150 is assembled onto its corresponding edge 155 of the shower panel 10A, the edge is received by the C-bracket 392 and supported therein. An additional notch 398 is provided along the bottom of the bottom leg 150, which is designed to receive sealing tape to provide for waterproofing along the bottom of the frame support 100.

In certain embodiments, a further layer of silicone foam tape (not shown) is adhered along the edges of the shower wall panels 10A–10E which extend into the C-brackets 195,367,377 and 392, such that the tape is positioned in between the C-brackets and the edges of the shower wall panels. The tape seals the interface between the shower wall panels 10 and the C-brackets 195,367,377 and 392, and also provides waterproofing. Specifically, the tape covers all portions of the shower wall panels 10 that are in contact with (or potentially in contact with) the C-brackets 195,367,377 and 392, e.g., the tape is positioned both along the outer edges of the shower wall panels (perpendicular to the layers 20–50) as well as on the portions of the outer surfaces of the outermost layers that extend into the C-brackets 195 (e.g., the perimeters of the outer surfaces of the layers 40 and 50). Such foam tape can be adhered to the shower wall panel 10 by any of a number of acrylic adhesives. In alternate embodiments, different types of tape or other materials can be employed.

In alternate embodiments, the C-brackets 195,367,377 and 392 can include rounded or other protrusions that protrude farther into the interior of the C-bracket by the rounded protrusions 200. Although not shown with respect to the end/top leg 110 or corner leg 170 of FIGS. 4 and 5, exemplary rounded protrusions 397 are shown in the C-bracket 392 of FIG. 6 (although in such protrusions in the preferred embodiment are not present). When employed, the rounded protrusions extend far enough into the C-brackets so as to effectively grip the shower wall panel(s) 10 into place, but not so far as to scrape or otherwise damage the edges the shower wall panels.

While all of the layers of the shower wall panel 10 could conceivably extend into the C-brackets 195,367,377,392, in the preferred embodiment only the protective coating layer 40, the frosted acrylic material layer 20, the reflective material layer 30 and the protective paint layer 50 extend into the C-brackets 195 while the remaining layers 60–90 extend up to (or nearly up to) the respective interior sides 190 of the frame members 110,120,130 and 140. In an alternate embodiment, the first adhesive layer 60 also extends into the C-brackets. In another alternate embodiment, only the frosted acrylic material layer 20, which provides the bulk of the material of the layers, would extend into and be supported by the frame support 100. It should be noted that the thicknesses of the layers shown in FIG. 1 are not drawn to exact scale, although FIG. 1 does show figuratively some of the relative thicknesses.

As shown in FIG. 2, the respective legs 110,120,130,140, 150,160 and 170 of the frame support 100 can be held together by way of a four screws or bolts 199 (shown in phantom). Although not shown in FIG. 3, the legs of the frame support 200 can also be held together in this manner. The screws/bolts 199 extend from the end and corner legs 110,120,210,220,170,290,295, through holes (not shown) in those legs, into grooves 400 that exist within each of the neighboring top legs 130,140,230,240,250 and bottom legs 150,160,260,270,280 (see FIGS. 4 and 6).

Because in the present embodiment each of the top legs shares the same cross-section with each of the end legs, each of the end legs likewise have a respective groove 400. Also, the corner legs 170,290 and 295 each have grooves 401. However, rather than being used to receive screws/bolts 199 for coupling together the various legs of the frame supports 100,200, the grooves 400,401 of the end and corner legs instead are configured to receive fasteners (e.g., clips) from face pieces 405,410 (see FIGS. 2 and 3) that are used to close off the ends of the end and corner legs, respectively. The face pieces 405,410 close off the ends of the hollow end and corner legs, respectively, which otherwise would be exposed. Although the face pieces 405,410 are only shown in FIGS. 2 and 3 along the top of the frame supports 100,200, similar face pieces also exist along the bottom of those supports.

The frame support 100 holding the shower wall panel 10 can be affixed to other frame supports for other shower wall panels, as well as to the walls or other structures within the room in which the shower is to be located, by way of a variety of techniques. In one embodiment, the legs are mounted to stud walls and/or are interlocked with one another. In another embodiment, holes (not shown) are formed within the flange portions 310 of the end and top legs 110,120,130,140,210,220,230, 240,250, such that screws or bolts can be employed to affix the frame supports 100,200 to other structures. As shown in FIGS. 2 and 3, the legs of the frame supports 100,200 are assembled to one another so that the edges of the panels 10A–10E are entirely surrounded by the frame supports 100,200, as shown in phantom in FIG. 2.

While the foregoing illustrates and describes the preferred embodiments of this invention, it is to be understood that the invention is not limited to the precise construction herein disclosed. The invention can be embodied in other forms without departing from the spirit or essential attributes of the invention. For example, in certain alternate embodiments, only a few of the layers, e.g., the layers 20,30,40 or the layers 20,30,50, are included within the panel 10. In other embodiments, the invention can relate only to the particular configuration or design of the frame supports (or the legs or other frame support members), rather than to (and independent of) the design, type or number of panels that are supported by the frame supports. Accordingly, reference should be made to the following claims, rather than to the foregoing specification, as indicating the scope of the invention.

Therefore, the invention should not be limited to just the described embodiment. To ascertain the full scope of the invention, the following claims should be referenced.

INDUSTRIAL APPLICABILITY

The invention provides improved panels useful in constructing bathing enclosures.

We claim:

1. A bathing enclosure wall panel, comprising:

a first layer of acrylic material having a translucent, cloudy and frosted appearance;

a second layer of reflective material that is coupled to the first layer, wherein the panel is structured so that a first portion of light incident on the first layer is reflected by the first layer, and a second portion of the light incident on the first layer is transmitted through the first layer to the second layer, reflected by the second layer, and transmitted back through and out of the first layer; and at least a third layer of an additional material that is coupled to one of the first layer and the second layer.

2. The panel of claim 1, wherein the first layer is extruded acrylic material.

3. The panel of claim 2, wherein the first layer includes a frosting additive.

4. The panel of claim 3, wherein the first layer has a colored appearance.

5. The panel of claim 1, wherein the second layer comprises aluminum.

6. The panel of claim 1, wherein the third layer is a backing layer connected to the second layer and is made of a cellulosic material.

7. A bathing enclosure wall panel, comprising:

a first layer of acrylic material having a translucent and frosted appearance;

a second layer of reflective material that is coupled to the first layer; and at least a third layer of an additional material that is coupled to one of the first layer and the second layer, wherein the third layer is a backing layer connected to the second layer and is made of a cellulosic material, wherein a protective paint coating is sandwiched between the third layer and the second layer.

8. The panel of claim 7, wherein the protective paint layer comprises urethane paint.

9. The panel of claim 7, wherein the third layer comprises a double-faced hexacomb material.

10. The panel of claim 1 mounted in a four-legged frame surrounding four ends of the panel, each of the legs of the frame having an internal, inwardly facing groove for receiving a respective edge of the panel.

11. The panel of claim 10, wherein the legs of the frame are screwed into each other.

12. The panel of claim 10 mounted in a seven-legged frame within which is also mounted a second panel, wherein two of the seven legs of the frame are end legs, two of the seven legs of the frame are top legs, two of the seven legs of the frame are bottom legs, and a final of the seven legs of the frame is a corner leg.

13. The panel of claim 12, wherein the corner leg includes a diagonal face connecting two interior faces of the corner leg that are respectively parallel to the two panels.

14. The panel of claim 10 mounted in a ten-legged frame within which is also mounted second and third panels, wherein two of the ten legs of the frame are end legs, three of the ten legs of the frame are top legs, three of the ten legs of the frame are bottom legs, and two of the ten legs of the frame are corner legs.

* * * * *